US005305631A

United States Patent [19]

Whited et al.

[11] Patent Number: 5,305,631

[45] Date of Patent: Apr. 26, 1994

[54] CATHODIC PROTECTION AND LEAK DETECTION PROCESS AND APPARATUS

[75] Inventors: Timothy A. Whited, Nederland; Jack L. Leatherman, Littleton; John L. Markham, Nederland, all of Colo.

[73] Assignee: Corrocon, Inc., Nederland, Colo.

[21] Appl. No.: 899,432

[22] Filed: Jun. 16, 1992

[51] Int. Cl.[5] ..... G01M 3/32

[52] U.S. Cl. ..... 73/49.2; 220/565

[58] Field of Search ..... 73/49.2, 40.7; 220/565

[56] References Cited

U.S. PATENT DOCUMENTS

| | | | |
|---|---|---|---|
| 3,461,051 | 8/1969 | Vrable | 204/147 |
| 3,995,472 | 12/1976 | Murray | 73/49.2 X |
| 4,567,925 | 2/1986 | Butts | 340/605 |
| 4,682,492 | 7/1987 | Green | 73/49.2 |
| 4,710,644 | 12/1987 | Baach | 307/95 |
| 4,832,122 | 5/1989 | Corey et al. | 166/266 |
| 4,834,194 | 5/1989 | Manchak, Jr. | 175/50 |
| 4,875,031 | 10/1989 | Fillippi et al. | 340/605 |
| 4,896,528 | 1/1990 | Lewis | 73/40.7 |
| 4,918,978 | 4/1990 | Green | 73/49.2 |
| 4,939,833 | 7/1990 | Thomas | 29/401 |
| 5,048,324 | 9/1991 | Thompson | 73/40.7 |
| 5,065,893 | 11/1991 | Kroon et al. | 220/565 |

FOREIGN PATENT DOCUMENTS

| | | | |
|---|---|---|---|
| 1804441 | 5/1970 | Fed. Rep. of Germany | 73/40.7 |
| 2329525 | 1/1975 | Fed. Rep. of Germany | 73/49.2 |
| 7787 | 1/1977 | Japan | 73/40.7 |
| 223839 | 9/1990 | Japan | 73/49.2 |

OTHER PUBLICATIONS

"Mac Monitor", Advertising brochure and operating instructions.

Garrity, K. C., Urgas, Michael, "Cathodic Protection of External Tank Bottoms", *Materials Performance*, Apr., 1980.

Cathodic Protection of Aboveground Petroleum Storage Tanks. American Petroleum Institute, 1991.

Furillo et al., "Tank Bottom Inspection Methods", *Aboveground Storage Tanks*, Paper No. 17, Jan. 14, 1992.

Surkein, Michael B., "Aboveground Storage Tank Double Bottom Cathodic Protection", *Aboveground Storage Tanks*, Paper No. 28, Jan. 14, 1992.

Kroon, David H., "Cathodic Protection of Above Ground Storage Tank Bottoms", *Aboveground Storage Tanks*, Paper No. 29, Jan. 14, 1992.

McJones, Stephen F., "Retrofitting Storage tanks with double bottoms and an improved cathodic protection system for hot services", *Aboveground Storage Tanks*, Paper No. 33, Jan. 14, 1992.

Koszewski, Lou, "Impressed Current Cathodic Protection for New and Existing Aboveground Storage Tank Bottoms with Secondary Containment", *Aboveground Storage Tanks*, Paper No. 40, Jan. 14, 1992.

Garriety, Kevin C., "Cathodic Protection of Tank Bottoms", *Aboveground Storage Tanks: A State-Of-The-Art Review*, Jun. 26, 1990.

Nichols, Paul R., "Experiences with Cathodic Protection of Aboveground Storage Tanks and a Review of API RP 651-Cathodic Protection of Aboveground Petroleum Storage Tanks", *Aboveground Storage Tanks: A State-of-The-Review*, Jun. 26, 1990.

Heugten, H. L., "Overview of External Corrosion-Control Methods for Aboveground Storage Tanks", *Aboveground Storage Tanks: A State-of-the-Art Review*, Jun. 26, 1990.

Seebold, James G., "Chevron's Experience with Leak Detection Methods for Aboveground Storage Tanks", *Aboveground Storage Tanks: A State-of-the-Art Review.*

*Primary Examiner*—Hezron E. Williams

*Assistant Examiner*—Joseph W. Roskos

*Attorney, Agent, or Firm*—Stephen A. Gratton

[57] ABSTRACT

Process and apparatus for detecting leaks in, cathodically protecting, determining the effectiveness of such cathodic protection, and/or remediating fluid leaked from an aboveground storage tank. At least one substantially horizontal bore is formed beneath an aboveground storage tank and a slotted pipe or casing is positioned within the bore. The pipe or casing can be simultaneously advanced within the substantially horizontal bore while the bore is being formed. Slotted tubing and at least one anode are positioned within the slotted casing. The bore is filled with coke breeze and current is supplied to the anode(s) to cathodically protect substantially the entire tank bottom. The anode and slotted tubing can be removed to provide a passageway for remediation of fluid leakage from the storage tank.

20 Claims, 5 Drawing Sheets

CATHODIC PROTECTION AND LEAK DETECTION PROCESS AND APPARATUS

BACKGROUND OF THE INVENTION

The present invention relates to process and apparatus for detecting leaks in and/or cathodically protecting an aboveground fluid storage tank, and more particularly, to process and apparatus for detecting leaks across and cathodically protecting substantially the entire bottom surface of an aboveground fluid storage tank while permitting access to the area below the bottom surface of a storage tank should remediation of the ground below the storage tank and/or recovery of a leaked fluid be required.

Fluids and products, such as water, crude oil, refined petroleum products, petrochemicals, or chemicals are conventionally stored for transportation and/or further processing in aboveground, stationary storage tanks, vessels, or containers. These conventional storage tanks are generally cylindrical in configuration. The bottom of these storage tanks is in contact with the ground upon which the tank is positioned. Tank(s) may be juxtaposed to a producing oil well or a pipeline terminal in the field to storage produced liquid hydrocarbons for transportation to a refinery or a plurality of tanks may be present at a refinery to store both crude oil and refined petroleum products. Tens of thousands of such conventional aboveground storage tanks have been previously constructed and installed and have been in service for many years. Substantially all of these storage tanks are constructed of metal, such as steel alloys.

Metallic containers positioned upon and/or partially within the ground are subject to failure due to a variety of corrosion processes that affect both the internal and external surfaces of the tank bottom. Given time, metallic, aboveground storage tanks will develop fluid leaks due to corrosion of the bottom surface thereby releasing water, crude oil, refined petroleum products, petrochemicals, and/or chemicals into the ground below the storage tank. If undetected and unmonitored, fluid leaks from an aboveground storage tank will contaminate the ground, soil and/or rock below the tank(s) as well as underlying aquifers.

Thus, considerable attention has been directed to cathodically protecting aboveground storage tanks in addition to monitoring such storage tanks to determine if fluid is leaking or has leaked from such tanks. Where the tank bottom is of a relatively small diameter and where the aboveground storage tank is effectively isolated from other aboveground and underground metallic structures so that current requirements for cathodic protection are small, aboveground storage tanks have been cathodically protected by the use of sacrificial anodes positioned within the ground about the periphery of the storage tank. Where current requirements are significant, impressed current systems have been installed to cathodically protect aboveground storage tanks. Anodes for impressed current systems have conventionally been installed in one of two manners. First, impressed current anodes have been installed in deep well or remote ground bed configurations which may be remote from the storage tank. Deep well designs involve placement of anodes in generally vertical bores at depths of 100 feet or more. Secondly, impressed current anodes have been installed at relatively shallow depths about the periphery of the tank either juxtaposed to the tank perimeter or at a site which is distant from the tank. Electrical current from such impressed current systems is largely consumed within the perimeter areas of the tank bottom. Thus, corrosion protection decreases from periphery of the tank bottom to the center. In an attempt to compensate for the deficiencies of these impressed current systems, electrical current to such systems has been significantly increased. However, increased current has resulted in excessive total current output and operating costs and stray current interference problems.

Procedures and equipment for volumetric testing, inventory reconciliation, and acoustic emissions testing have been developed and physical tank bottom inspections have been conducted from within the tank to either determine the existence of a leak or measure the amount of a fluid discharged through a leak in an aboveground tank bottom. However, none of these procedures, equipment, or inspections assess the actual conditions within the ground below the tank bottom, nor have they proved to be economical or capable of determining low volumes of fluid loss. Thus, a need exists for process and apparatus for cathodically protecting substantially the entire bottom of an aboveground storage tank for economically, timely and accurately detecting fluid leaks from an aboveground storage tank and for providing access to the area below the bottom of an aboveground storage tank for soil remediation, to contain a leaked fluid, and to prevent further migration of the leaked fluid in situ.

Accordingly, it is an object of the present invention to provide a process and apparatus for cathodically protecting substantially the entire bottom of an aboveground storage tank.

It is another object of the present invention to provide a process and apparatus for monitoring substantially the entire area below an aboveground storage tank for the existence of a fluid tank.

It is also an object of the present invention to provide apparatus which will allow contaminated ground, soil, and/or rock below an aboveground storage tank to be remediated and/or inhibit migration of a fluid which has leaked from an aboveground storage tank.

It is a further object of the present invention to position a perforated or slotted pipe or casing under an aboveground storage tank to be used for the determination of accurate structure-to-soil potentials so as to define the effectiveness of a cathodic protection system.

It is also a further object of the present invention to provide a process and apparatus for simultaneously boring and casing a generally horizontal subterranean bore.

It is a still further object of the present invention to provide portable apparatus for accurately obtaining structure-to-soil potential measurements from any location within perforated or slotted pipe which is positioned below an aboveground storage tank.

SUMMARY OF THE INVENTION

To achieve the foregoing and other objects, and in accordance with the purposes of the present invention, as embodied and broadly described herein, one characterization of the present invention comprises a process for inhibiting corrosion of and detecting leaks from an aboveground fluid storage tank. The process comprises positioning slotted tubing and at least one impressed current anode within a slotted casing beneath an aboveground storage tank and transmitting electrical current to the at least one anode so as to cathodically protect substantially the entire surface of the bottom of the aboveground storage tank. The at least one anode is positioned outside of and adjacent to said slotted tubing.

In another characterization of the present invention, cathodic protection, leak detection, and/or remediation apparatus is provided for use in conjunction with an aboveground liquid storage tank. The apparatus comprises slotted, corrosion, resistant tubing positioned in a slotted casing beneath the bottom of the storage tank, at least one anode positioned within the slotted casing and juxtaposed with the tubing, and an assembly for providing electrical current to said at least one anode.

In yet another characterization of the present invention, a process is provided for detecting leaks from an aboveground storage tank. The process comprises positioning a slotted tubing within a slotted casing beneath an aboveground storage tank and monitoring fluid transmitted via the slotted tubing to determine leakage of fluid from the storage tank.

In still another characterization of the present invention, a process is provided for forming a subterranean bore. The process comprises positioning a drill rod having a bit secured to one end thereof within a first length of casing having an expander cap secured to one end thereof, such that the bit extends through the cap, and driving the bit and the cap into the ground so as to form a subterranean bore. The first length of casing is simultaneously advanced within the bore while the bore is being formed.

In yet a further characterization of the present invention, a boring assembly is provided which comprises a generally tubular member having a first portion and a second portion. The second portion of the generally tubular member defines an end face. The tubular member is adapted to be secured to a pipe. The boring assembly also comprises a boring bit having a tip, a chamfered face and a generally cylindrical shank. The boring bit is received within the tubular member such that the tip and the chamfered face extend beyond the end face. The tip, chamfered face and end face define a boring surface. The boring bit is adapted to be connected to a drill rod.

In yet a still further characterization of the present invention, an apparatus is provided for obtaining structure-to-soil potential measurements within a slotted pipe positioned within the ground. The apparatus comprises a reference electrode, a member for absorbing liquid which is secured to said electrode, an assembly for providing liquid adjacent the electrode, and an assembly for recording structure-to-soil measurements. The recording assembly is electrically connected to the reference electrode.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE PREFERRED EMBODIMENTS

Figure 1:
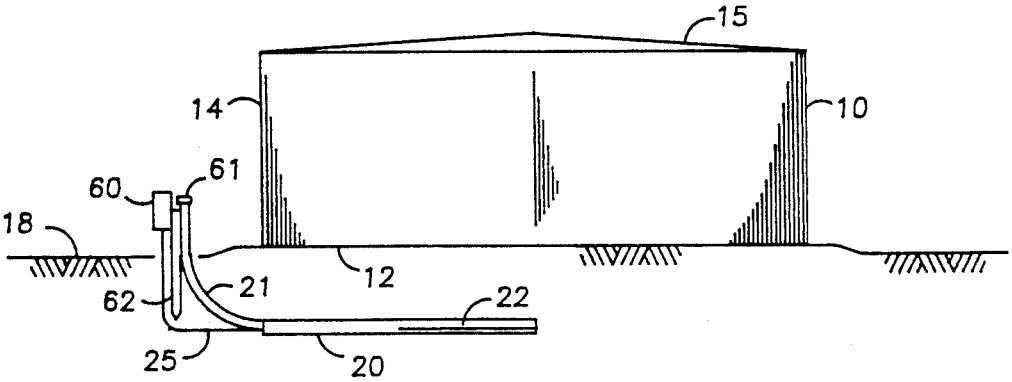
FIG. 1 is a partially cutaway, partially cross-sectioned elevation view depicting the apparatus of the present invention including an impressed current anode positioned within a slotted pipe in a generally horizontal bore beneath an aboveground storage tank.

Referring to FIG. 1, an aboveground liquid storage tank 10 has a generally cylindrical configuration defining a tank bottom 12, side walls 14, and tank top 15. Tank 10 contains a fluid, for example, water, crude oil, refined petroleum products, petrochemicals, and/or chemicals. Tank bottom 12 is positioned upon and supported at least in part by ground 18. In accordance with one embodiment of the present invention, at least one bore 20 is drilled underneath tank bottom 12 in a manner described below and in a generally horizontal direction. It is not necessary to remove liquid from tank 10 prior to drilling bore 20. Each generally horizontal bore 20 is equipped with a corrosion resistant, slotted pipe 22, such as slotted polyvinyl chloride pipe. Each slotted pipe 22 may be formed from several commercially available lengths of slotted pipe joined together in a manner as will be evident to a skilled artisan. As utilized throughout this specification, the term "slotted" includes slots, perforations, and other apertures. Each slotted pipe 22 is in turn equipped with one or more anodes 24 in a manner as is also described herein.

Figure 2:
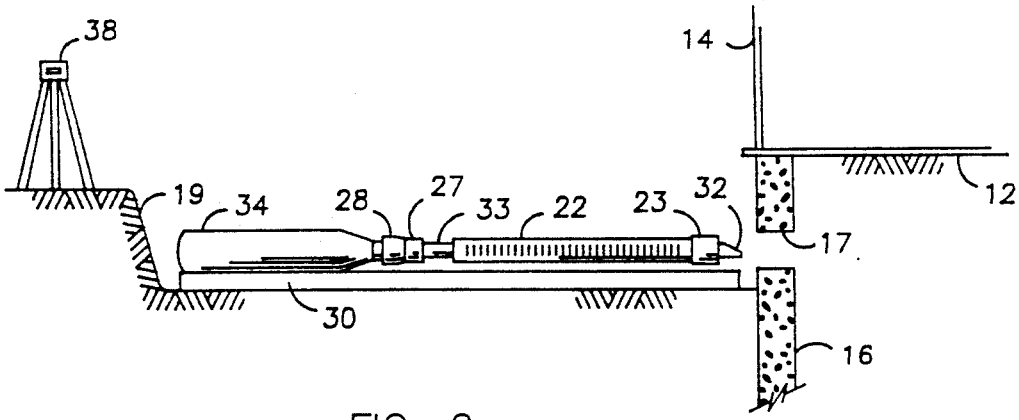
FIGS. 2 and 3 are partially cutaway, partially cross-section elevation views depicting a pneumatic driver and associated launching structure within an excavated pit adjacent an aboveground storage tank as utilized to bore and case a generally horizontal bore beneath the storage tank in accordance with the process of the present invention.
Figure 3:
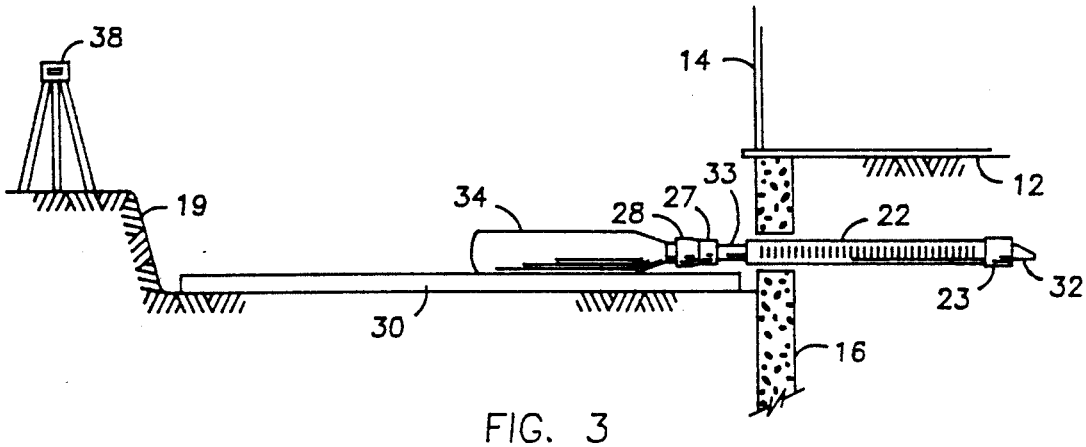
Figure 4:
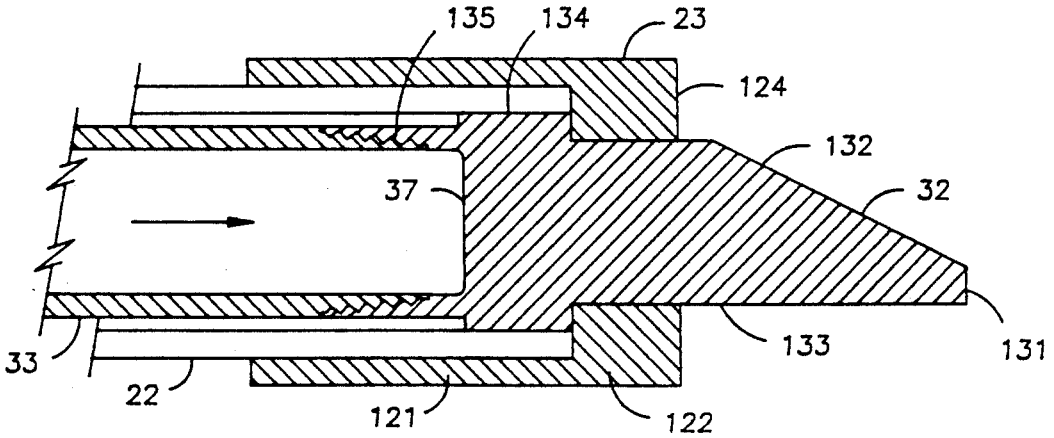
FIG. 4 is a partially cutaway, cross-sectioned pictorial view of the boring bit and drill rod as connected to a slotted casing or pipe during boring or drilling of a generally horizontal bore in accordance with the present invention.
Figure 5:
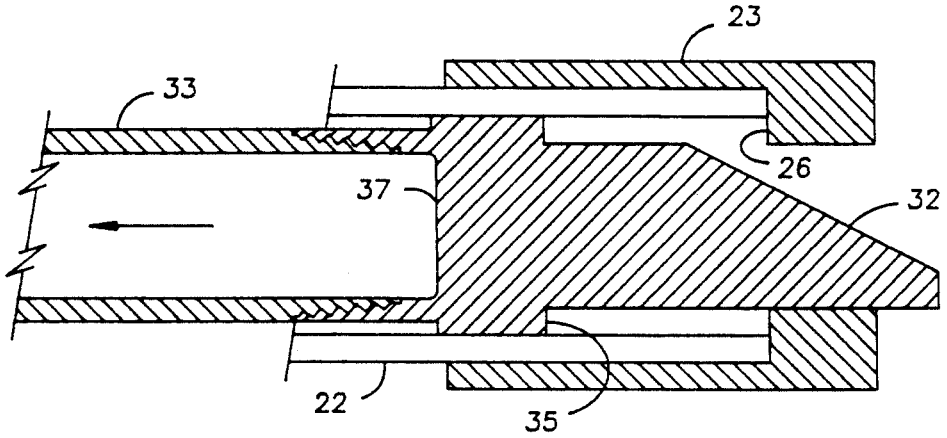
FIG. 5 is a partially cutaway, cross sectioned pictorial view of the boring bit and drill rod as being removed from a slotted casing or pipe during boring or drilling of a generally horizontal bore in order to change the boring bit or at completion of such boring or drilling in accordance with the present invention.

As illustrated in FIG. 2, a pit 19 is formed, such as by excavation, adjacent side wall 14 of an aboveground storage tank 10. The dimensions of excavated pit 19 will depend upon the number of bores to be drilled from the pit and the angle from the center of tank bottom at which such bores will be drilled. When pit 19 exposes a portion of support ring 16 upon which storage tanks are often supported, a hole 17 is drilled through support ring 16 if necessary to drill bore 20 or 70. Support ring 16 is constructed of, for example, concrete. Hole 17 may be drilled by any suitable means, for example, by a core drill. Pit 19 is equipped with a launching structure 30. Launching structure 30 is provided with a generally linear V-shaped groove (not illustrated) in the upper face thereof. An expanded cap 23 (FIGS. 4 and 5) is secured over one end of slotted pipe 22 by any suitable means such as by adhesive glue. A boring bit 32 is secured to a drill rod 33, such as by screw threads. The drill rod 33 and boring bit 32 are telescopically received within slotted pipe 22 such that a bit 32 extends through cap 23 until external shoulder 35 formed near one end of bit 32 abuts internal shoulder 26 on cap 23. Drill rod 33 is secured at its other end to a pneumatic driver 34 with a split drill rod adaptor 27 and nose fitting 28. A preferred pneumatic driver for use in the present invention is manufactured by Allied of Salon, Ohio under the trademark HOLE-HOG. The pneumatic driver 34 is received within the groove in the upper surface of launching structure 30 and thus guided by the launching structure 30. Driver 34 pneumatically drives boring bit 32, drill rod 33, expander cap 23 and slotted pipe 22 simultaneously through hole 17 in support ring 16 and into the ground beneath tank bottom 12. Engagement of shoulder 35 of boring bit 32 with shoulder 26 of cap 23 advances slotted pipe 22 within the bore 20 created by simultaneous advancement of boring bit 32 and cap 23 by pneumatic driver 34. Pneumatic driver 34 advances along launching structure 30 toward support ring 16 during drilling until driver 34 approaches the end of launching structure 30 as illustrated in FIG. 3. Driver 34, adaptor 27 and nose fitting 28 is then uncoupled from the length of drill rod 33 which has been advanced into the bore and the direction of advancement of driver 34 is reversed to move the driver to a position as illustrated in FIG. 2. An additional joint of slotted casing or pipe 22 is secured by any suitable means, such as, screw threads or a heat fused joint, to the end of the joint previously driven beneath tank bottom 12 and an additional joint of drill rod 33 is telescopically received within the new joint of slotted casing or pipe 22 and is secured to the rod joint previously driven beneath the tank bottom by any suitable means, such as screw threads. Driver 34 is then recoupled to the additional drill rod 33 by means of split adaptor 27 and nose fitting 28.

The process described above is repeated until the end of the slotted pipe 22 is advanced to a desired position beneath tank bottom 12. An elevation monitor 38, such as an elevation sensing instrument which includes a monitor connected to a probe by both air and oil lines and which is manufactured under the trade name designation Mac Monitor M-1 by Mac Monitor, Long Groove, Ill., is utilized to continuously monitor the elevation of boring bit 32 during the entire drilling process. The air and oil lines are inserted through split adaptor 27, are positioned within drill rod 33, and extend to a point adjacent inner face 37 of drill bit 32. In response to such elevation measurements, the orientation of bit 32 within bore 20 or 70 may be changed or a different bit 32 may be employed to correct the direction of bore 20 or 70. When a different bit is to be employed, bit 32 and drill 33 are removed from bore 20 through slotted pipe 22 (FIG. 5) by reversing pneumatic driver 34 and uncoupling length(s) of drill rod 33 within pit 19 until bit 32 is recovered. A different bit 32 is then secured to a length of drill rod which in turn is advanced through pipe 22 together with other lengths of drill rod by means of pneumatic driver 34 in a manner as is described herein. In this manner, a generally horizontal bore 20 or 70 can be drilled. As utilized throughout this specification in conjunction with the term "bore", "horizontal" refers to a line connecting the terminus of a bore with the point of origin of the bore which deviates by no more than 10 degrees from a horizontal plane.

Thus, it will be evident to the skilled artisan that the process of the present invention for boring generally horizontal bores beneath an aboveground storage tank as described above advances bit 32 and expander cap 23 by percussion beneath the tank bottom 12 by compacting and displacing soil radially away from the bore being formed while simultaneously advancing slotted pipe 22 within the same bore. This process eliminates the need for positioning casing or pipe within a previously formed bore and the problems associated therewith, for example bore collapse due to soil movement, caving and/or sloughing or reduction of bore diameter due to soil swelling. Further, soil is not removed from under the storage tank during drilling thereby ensuring the structural integrity of the ground in supporting the storage tank. In addition, the problems of soil compaction and attendant storage tank settling which is encountered by the use of compressed air or water during drilling are eliminated by the process of the present invention.

Boring bit 32 and expander cap 23, as mated, form a bit assembly capable of being advanced by percussion to form a subterranean bore. Bit 32 has a tip 131, a chamfered boring face 132, a generally cylindrical shank 133, a generally cylindrical collar 134 and a generally tubular, hollow female coupling section 135. Shank 133 and collar 134 define a generally annular shoulder 35 therebetween. The interior of female coupling section 135 is preferably threaded and terminates near inner face 37. Preferably, bit 32 is integrally formed as one member which is solid except for the follow portion of coupling section 135. Bit 32 may be constructed of any suitable material as will be evident to the skilled artisan. As constructed, expander cap 23 is adapted to be releasably secured to drill rod 33 by any suitable means, such as screw threads. Expander cap 23 is a generally tubular member of uniform outer diameter and has first and second generally tubular sections 121, 122 which are integrally formed of any suitable material, for example, steel, plastic, or polyvinyl chloride resin. One end of cap 23 defines a generally annular boring face 124. Second tubular section 122 of cap 23 has a reduced inner diameter so as to define a generally annular internal shoulder 26 between sections 121 and 122. Cap 23 is adapted to receive slotted casing or pipe 22 within section 121 until the end of pipe 22 abuts or is adjacent to shoulder 26, bit 32 is received within cap 23 until shoulder 35 of bit 32 abuts shoulder 26 of cap 23. As thus assembled for boring, tip 131, chamfered boring face 132 and a portion of shank 133 extend through second tubular section 122 of expander cap 23. As advanced into the ground, tip 131 and chamfered face 132 of bit 32 and annular face 124 of expander cap 23 function to compact and displace ground, rock and/or soil radially away from the subterranean bore being created.

Figure 6:
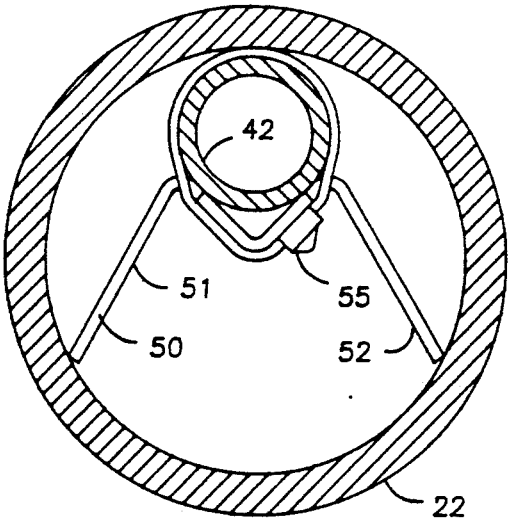
FIG. 6 is a partially cutaway, cross-sectioned pictorial view of apparatus of the present invention including a slotted vent and monitor pipe and a centralizer.
Figure 7:
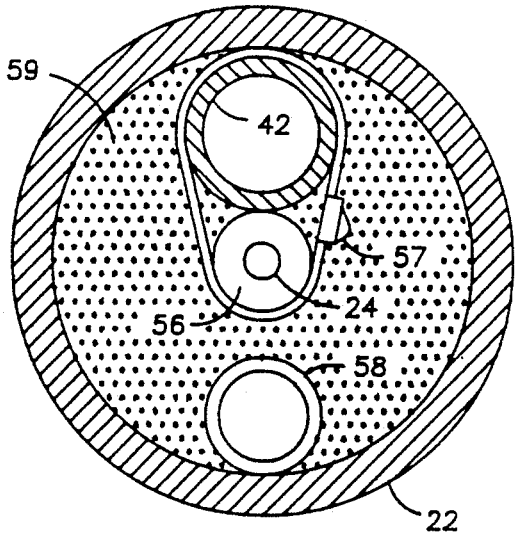
FIG. 7 is a cross-sectional view of an impressed current anode, slotted vent and monitor pipe, and flexible tubing as positioned within a slotted pipe or casing in a generally horizontal bore in accordance with the present invention.
Figure 8:
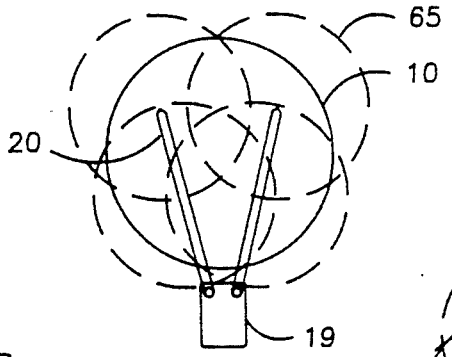
FIGS. 8–11 are plan views of arrangements of impressed current anodes within the generally horizontal bores beneath the bottom of an aboveground storage tank in accordance with the present invention.
Figure 9:
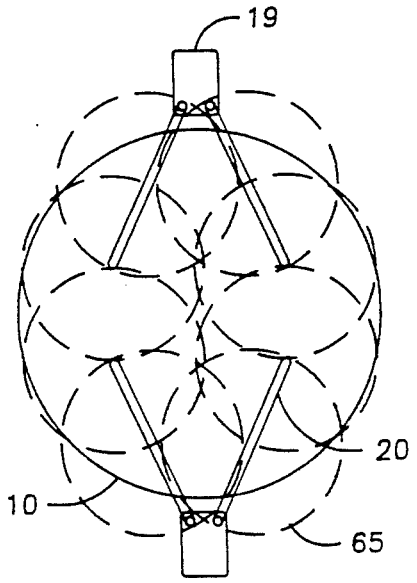
Figure 10:
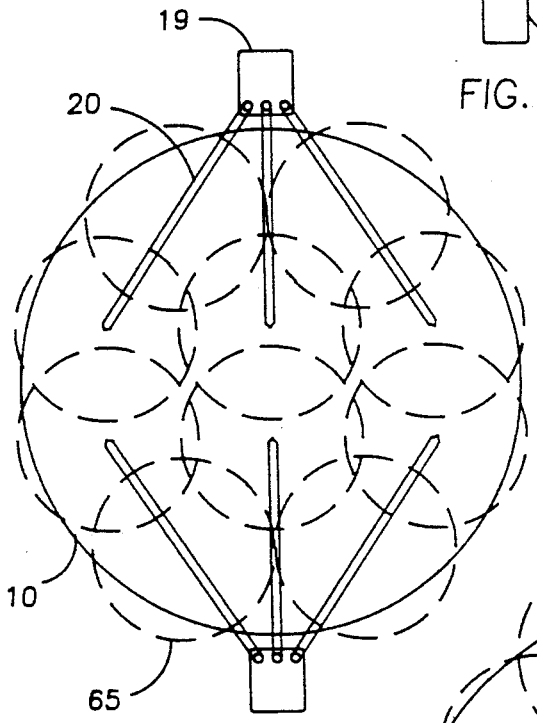
Figure 11:
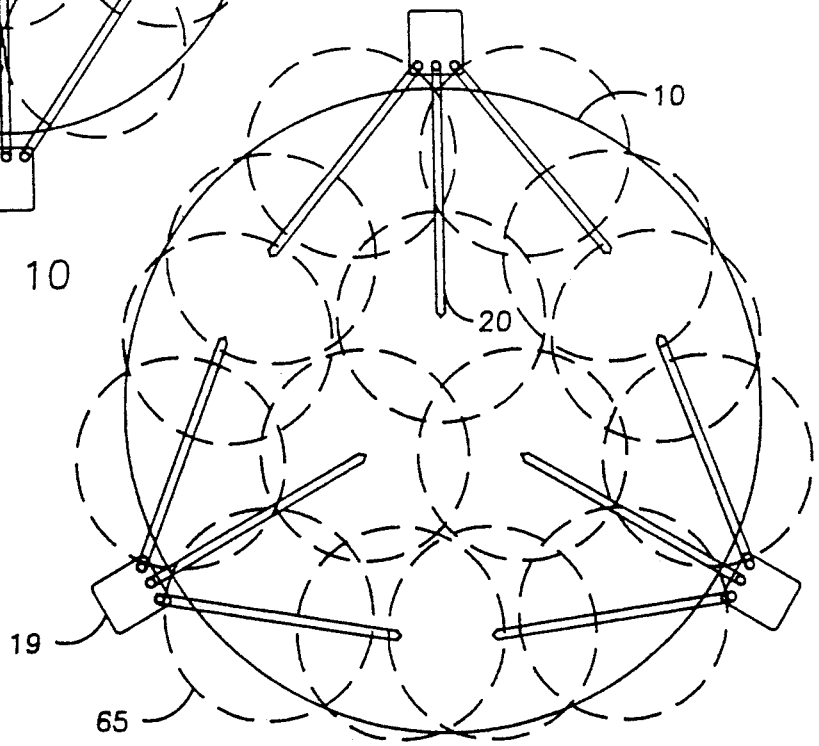

Once slotted pipe 22 is properly positioned beneath tank bottom 12, boring bit 32 and the drill rod 33 are removed through slotted pipe 22 (FIG. 5) by reversing pneumatic driver 34 and uncoupling lengths of drill rod 33 within pit 19 as the lengths of rod are removed from bore 20. A smaller diameter slotted vent and monitor tube 42 together with at least one anode 24 are positioned within slotted pipe 22 in the substantially horizontal bore 20. Preferably, anode 24 and tube 42 are positioned within slotted casing or pipe 22 by means of at least one centralizer 50. Usually, several centralizers 50 will be secured by any suitable means, such as clamp 55, at intervals along the length of slotted vent and monitor tube 42. Centralizers 50 support tube 42 along substantially the entire length thereof and, as illustrated in FIG. 6, position tube 42 at the top of the inside diameter of slotted pipe or casing 22. As illustrated in FIG. 6, centralizer 50 is constructed and sized so that one end of each leg 51, 52 contacts the inner wall of pipe 22. As illustrated in FIG. 7, one of more anodes 24 are secured to vent and monitor tube 42 by means of clamp(s) 57 and centering bushings 56 at spaced intervals along the length of tube 42. As secured to tube 42 and positioned within slotted pipe or casing 22, anodes(s) 24 are generally aligned with the axis of slotted pipe or casing 22.

As thus assembled, vent and monitor tube 42, anode 24 and centralizer 50 are suitably positioned within slotted pipe or casing 22 and are advanced therein by any suitable means, such as by manual manipulation, until vent tube 42 and anode 24 reach a desired position. Preferably, this desired position is reached when the end of pipe 42 contacts expander cap 23 at the end of pipe 22. An anode lead wire 25 which is attached to anode 24 extends through slotted casing or pipe 22 so as to carry electrical current to the anode. A flexible tubing 58 is also positioned within slotted casing or pipe 22 below anode 24. Preferably, flexible tubing 58 is passed through pipe 22 under anode 24, and is simultaneously advanced with pipe 42, anode(s) 24 and centralizer(s) 50 within pipe 22 until the end of tubing 58 is proximate to the end of pipe 22. Thereafter, coke breeze 59, preferably a fine grade of calcined petroleum coke breeze, is injected in a dry form into flexible tubing 58 by means of a pneumatic displacement vessel as tubing 58 is retracted from pipe 22 thereby completely filling pipe 22 and surrounding anode 24 and pipe 42 with coke breeze. Also, coke breeze extends through slotted pipe 22 into contact with the surrounding soil, rock and/or ground. Over time, steel centralizer 50 and clamps 55 and 57 will completely corrode thereby leaving anode 24 and pipe 42 within slotted pipe or casing 22.

As illustrated in FIG. 1, anode lead 25 is connected to a current control junction box 60 adjacent tank 10 while slotted vent and monitor pipe 42 is connected to an adapter 61 for leak detection and for venting anode 24 by means of access pipe 21. Junction box 60, adapter 61 and access pipe 21 may be secured to post 62. Junction box 60 is equipped with shunts to measure current output of anode 24 and a rheostat in the incoming electrical power supply circuit to control the electrical current supplied to the anode. Pit 19 can be filled with soil, dirt, gravel, etc., once all electrical devices and connections have been thoroughly tested. When installing the apparatus described above during the construction of a new aboveground storage tank or reconstruction of an existing aboveground storage tank, slotted pipe or casing 22, anode(s) 24 and/or monitor tube 42 can be positioned in accordance with the present invention by other suitable means, for example by trenching.

Referring now to FIGS. 8-11, several horizontal bore(s) and corresponding impressed current anodes arrangements are illustrated. Each of these arrangements are designed to cathodically protect substantially the entire bottom of an aboveground storage tank by distributing electrical current substantially uniformly and symmetrically across the entire bottom. These arrangements are dictated by the radius of influence 65 of cathodic protection current from each horizontal bore 20 and the diameter of the tank bottom to be protected. The radius of influence 65 is in turn dictated by the resistivity of the soil, gravel, rock, etc. within which each anode is positioned. Each of these arrangements also results in controlled density of cathodic protection current, total electrical current output which is lower than that for conventional impressed current anode systems, and reduced stray current interference problems.

Slotted vent and monitor tube 42 which is present within the slotted pipe or casing 22 in each generally horizontal bore 20 permits gas which is generated by reactions at each anode 24 to be vented via access pipe 21 and adaptor 61. Tube 42 can also be utilized to transport water to each anode 24 within the same horizontal bore when necessary as will be evident to the skilled artisan. Also, tube 42 is connected to an adapter 61 for leak detection. Due to gravity drainage and diffusion, vapors, gases and/or liquids resulting from a leak in an aboveground storage tank will migrate into slotted pipe 22 and tube 42. These vapors, gases and/or liquids can then be detected by any suitable leak detection means, such as manually by use of an air sampling vacuum pump and air monitor/analyzer, such as a portable photoionizer with datalogging manufactured by HNU Systems, Inc. under the trade name DL-101, or continuously by means of conventionally available systems that automatically extract and analyze an air sample from monitor tube 42.

Further, slotted pipe or casing 22 provides a means for remediating contaminated soil, ground, rock, etc. below an aboveground storage tank by several methods. For example, a vacuum can be pulled on pipe(s) 22 positioned beneath an aboveground storage tank thereby drawing vapors from the soil, ground, rock, etc. surrounding these pipe(s) to an aboveground treatment facility. Or the contaminated subterranean area may be bioremediated by injecting a solution of bacteria, and additional nutrients, via slotted pipe(s) 22 into the area surrounding these pipe(s) to degrade the pollutant to acceptable levels. Thus, pipe(s) 22 provide access to the area below an aboveground storage tank for remediation of contaminated soil and ground water while permitting the tank to remain in service. When used for remediation, all anodes 24 and the vent and monitor tube 42 are removed from slotted pipe(s) 22 in a manner as described below.

Should any anode 24 completely fail or deteriorate resulting in excessive voltage or should any lead wire 25 become severed, an anode 24 can be removed from slotted pipe or casing 22 and be replaced. Pit 19 is first reconstructed, if necessary, and a flexible tubing which is similar in construction to tube 58 is inserted into the end of tubing 22 exposed in pit 19. High pressure air is forced by any suitable means, such as a conventional air compressor, through the flexible tubing and into pipe 22 to force coke breeze out of pipe 22 and into a receiver. As the coke breeze is forced out of pipe 22, the flexible tubing is advanced into pipe 22 until the coke breeze is removed form pipe 22. Once coke breeze is removed from substantially the entire length of pipe 22, anodes 24 can be removed from pipe 22 by pulling lead wire 25 or vent and monitor tube 42 via pit 19. After anode(s) 24 and lead wire 25 are repaired or replaced, anode(s) and vent and monitor tube 42 can be inserted into pipe 22 as previously described.

Figure 12:
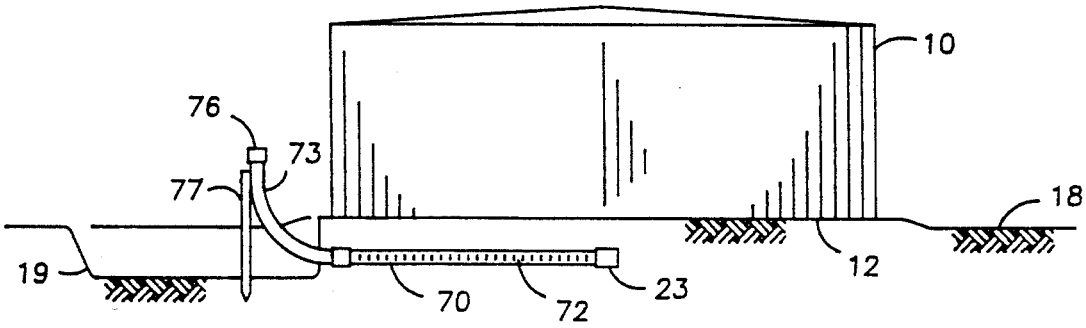
FIG. 12 is a partially cutaway, partially cross-sectioned elevation view depicting a slotted pipe as positioned in a generally horizontal bore beneath an aboveground storage tank in accordance with the present invention.
Figure 13:
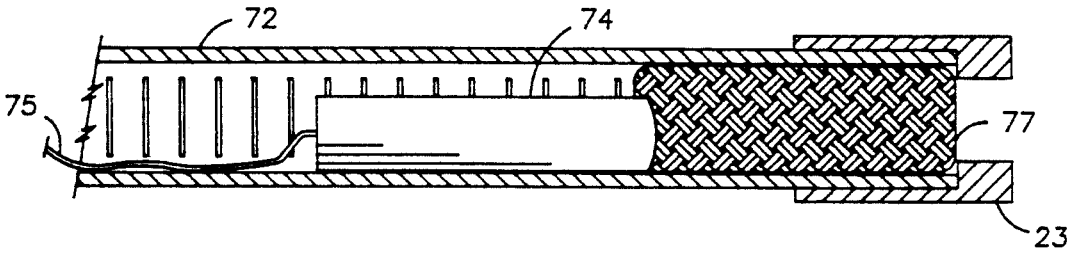
FIG. 13 is a partially cutaway, cross-sectioned pictorial representing a reference cell as positioned at the end of a slotted pipe.

In accordance with another embodiment of the present invention which is illustrated in FIGS. 12 and 13, a permanent reference cell 74, such as a copper-copper sulfate cell, is positioned within a generally horizontal bore 70 drilled beneath an aboveground storage tank 10 via pit 19 in a manner as previously described with respect to bore 20. Bore 70 is usually drilled at a lesser depth than bore(s) 20, for example, 1–4 feet as compared to 4–10 feet, respectively. Bore 70 can be provided with a slotted pipe or casing 72 into which a conventional reference cell 74 is positioned by means of, for example, a flexible tubing (not illustrated). Preferably, reference cell 74 is positioned against a mud plug 77 at the end of slotted pipe or casing 72 which is substantially beneath the center of the bottom of storage tank 10 as will be evident to the skilled artisan. Slotted pipe or casing 72 is usually connected to an adaptor 76 by means of access pipe 73. Reference cell 74 is connected by means of lead wire 75 to a reference cell terminal (not illustrated) which is secured to adaptor 76. As thus constructed and positioned, reference cell 74 provides accurate data regarding cathodic protection of the center of the bottom of an aboveground storage tank.

Figure 14:
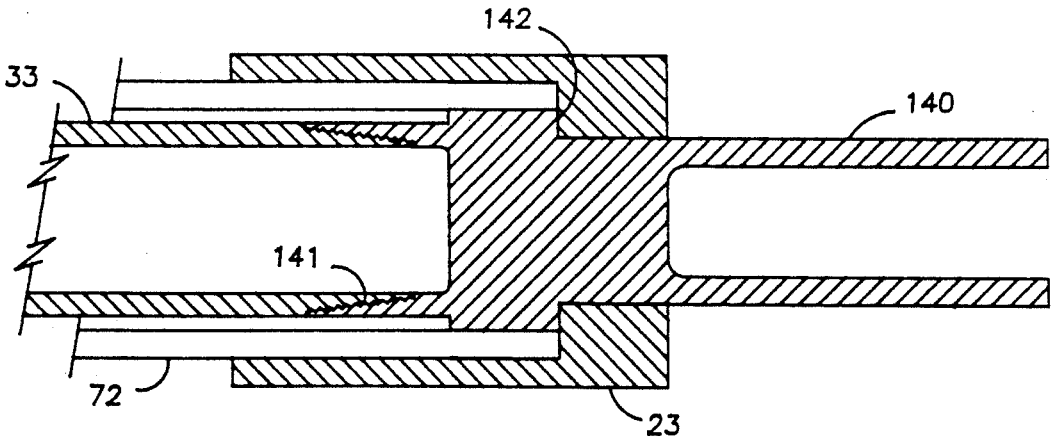
FIG. 14 is a partially cutaway, cross-sectioned pictorial view of member for soil sampling as secured to a drill rod and extending through an expander cap and into the soil.

Slotted pipe or casing 72 can be utilized in a manner similar to and in conjunction with slotted pipe or casing 22 for leak detection and/or soil or ground water remediation. Further, slotted pipe or casing 22 and/or 72 can be used to obtain a sample of soil from adjacent the end thereof either during or after completion of drilling or during or after operations in accordance with other aspects of the present invention. When pipe 22 and/or 72 are used for soil sampling, an open-ended, generally tubular member 140 is secured to the end of drill rod 33 by means of, for example, female coupling 141 as illustrated in FIG. 14. Member 140 and drill rod 33 are inserted into pipe 22 or 72 and member 140 extends through expander cap 23 until external shoulder 142 abuts expander cap 23. As extended through expander cap 23, member 140 collects soil within the interior thereof. Drill rod 33 and member 140 are removed from pipe 22 or 72 via pit 19 and the soil sample is removed from member 140 for further analysis or observation.

Figure 15:
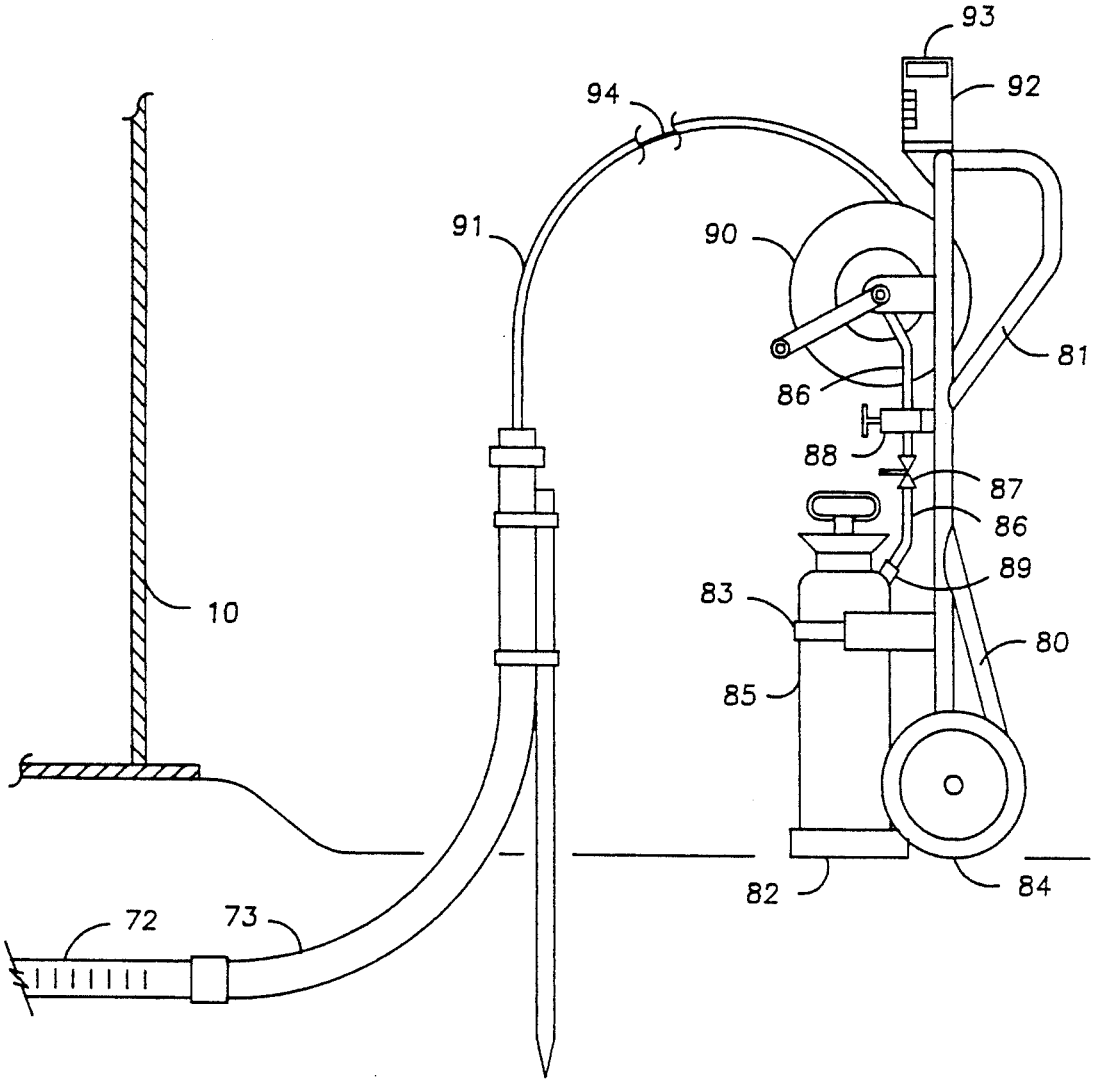
FIG. 15 is a partially cutaway, partially cross sectioned elevation view of apparatus of the present invention for measuring structure-to-soil potentials along a perforated or slotted pipe positioned within a generally horizontal bore below an aboveground storage tank.

To obtain an accurate structure-to-soil potential measurements from any location within slotted pipe or casing 22 or 72, a portable profile cart apparatus which is illustrated generally as 80 in FIG. 15 is provided. Apparatus 80 has a cart 81, a pressurized tank or container 85, flexible tubing 91, and a current measurement assembly 92. Cart 81 is a frame defining a bottom support 82 and to which two wheels 84 are rotatably secured. A pressurized tank 85 is positioned upon bottom support 82 and may be secured to cart 81 by any suitable means, such as by a strap clamp 83. Tank 85 is in fluid communication via spool reel 90 with flexible tubing 91 by means of hose 86, ball valve 87 and pressure regulator 88. Tank 85 can be removed from apparatus 80 for refilling by means of hose disconnect 89. Flexible tubing 91 is initially wound upon spool reel 90 during storage or transportation of apparatus 80. Spool reel 90 is secured to cart 81 by any suitable means, such as by welds or bolts (not illustrated). One end of flexible tubing 91 is secured to spool reel 90 so as to be in fluid communication with hose 86 and tank 85. Current measurement assembly 92 is comprised of a volt-ohm meter 93, insulated wire 94, and a reference cell 95. Volt-ohm meter 93 will have an additional lead wire (not illustrated) connected to the structure, i.e. tank, by any suitable means, such as a clamp, as will be evident to the skilled artisan. Reference cell 95 is secured to the other end of flexible tubing 91 and volt-ohm meter 93 is electrically connected to reference cell 95 by means of insulated wire 94 which is positioned within flexible tubing 91. Meter 93 is also secured to cart 81 by any suitable means, such as by clamps (not illustrated). Reference cell 95 has a generally cylindrical sponge end cap 96 secured to one end thereof.

Figure 16:
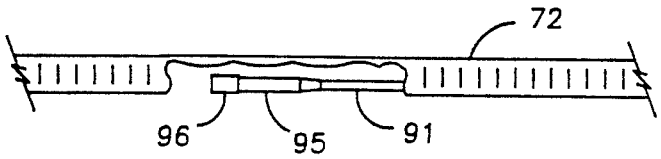
FIG. 16 is a partially cutaway elevational view of a reference cell as positioned within a slotted pipe for measuring structure-to-soil potentials along a generally horizontal bore beneath an aboveground storage tank.

When structure-to-soil potential measurements are desired, reference cell 95 is transported through access pipe 73 and into slotted pipe or casing 72 by manually pushing flexible tubing 91 into pipe or casing 72, as illustrated in FIG. 16. A supply of a suitable liquid, such as water, which is pressurized within tank 85 is continuously supplied via flexible tubing 91 to a point within tubing 72 which is adjacent reference cell 95. As tubing 91 and cell 95 are withdrawn from slotted pipe or casing 72, sponge end cap 96 absorbs water present within slotted pipe or casing 72 permitting reference cell 95 to accurately measure a structure-to-soil potential. In this manner, accurate structure-to-soil potentials can be profiled anywhere within the slotted pipe or casing to define the effectiveness of a cathodic protection system for the bottom of an aboveground storage tank. Once the flexible tubing 71 has been reeled onto spool reel 90 and reference cell 95 is withdrawn from slotted pipe or casing 72 and access pipe 73, the entire apparatus 80 can be easily moved to a new location so as to obtain structure-to-soil potential measurements within a separate slotted pipe or casing.

The following example describes the manner and process of making and using the present invention and sets forth the best mode contemplated by the inventor or carrying out the invention but is not to be construed as limiting the scope thereof.

EXAMPLE

To cathodically protect and provide access for leak detection of a 100 foot diameter aboveground storage tank, two pits are initially excavated an opposite sides of the storage tank. The launching structure is then positioned within the pit and the elevation monitor is assembled with the slotted casing in a manner as described above. Casing is then advanced under the tank using a pneumatic tool along with associated boring equipment. While forming a subterranean bore, the tank remains in service with product inside. The tank requires six 4 inch slotted casings to be installed horizontally at a depth of 6 feet below the tank bottom. The bore configuration is similar to the configuration illustrated in FIG. 10. One ¼ inch diameter, 4 foot long anode is installed in each of four angled casings. Two more anodes of like dimensions are installed in each of two center casings completing the eight anode installation. Vent and monitor tubes, with anodes attached, are installed and then coke breeze is injected into each horizontal bore. Long radius elbows are coupled to each casing and PVC risers are set before backfilling the excavated pit.

Additionally, a 1 ½ inch slotted PVC pipe is installed horizontally 1 foot, 6 inches below the tank bottom for reference cell insertion.

After electrical current is supplied to the installed cathodic protection system, the current output is adjusted to a desired level. The individual anode output is monitored and adjusted at each junction box.

Using the portable profile cart apparatus of the present invention, a reference cell is inserted into the 1 ½ inch slotted pipe. Structure-to-soil potential readings are then taken at specified intervals from the tank center to the perimeter. Final adjustments are then made to the cathodic protection system. The monitor piping is available to be used for leak detection purposes.

No significant potential shift is observed on adjacent structures when the system is energized. Stray current interference does not occur due to the anode locations.

Although the process of simultaneously drilling a bore while advancing slotted pipe or casing within the bore has been described herein with respect to drilling a generally horizontal bore beneath an aboveground storage tank, this process is also applicable to drilling a subterranean bore for other purposes, such as for utility or cable lines. When the drilling process of the present invention is employed for other purposes, the process can be employed with pipe or casing which is not slotted or perforated and/or corrosion resistant and can be utilized to drill bores which are vertical, horizontal or any other orientation.

The foregoing description of the preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A process for inhibiting corrosion of an aboveground fluid storage tank comprising:

positioning a slotted tubing and at least one impressed current anode within a slotted casing which is beneath an aboveground storage tank, said at least one anode being positioned outside of and adjacent to said slotted tubing; and transmitting electrical current to said at least one anode so as to cathodically protect substantially the entire surface of the bottom of said aboveground storage tank.

2. The process of claim 1 wherein said aboveground storage tank is an existing storage tank, said process further comprising:

forming at least one substantially horizontal bore beneath the bottom of said storage tank.

3. The process of claim 2 wherein said slotted casing is positioned within said at least one horizontal bore.

4. The process of claim 2 wherein said step of forming said at least one horizontal bore includes simultaneously advancing said slotted casing within each said at least one horizontal bore.

5. The process of claim 4 further comprising:

monitoring the elevation while forming each said at least one horizontal bore so as to ensure against striking or penetrating the bottom of said storage tank.

6. The process of claim 1 wherein said casing has a generally horizontal orientation.

7. The process of claim 1 wherein said at least one anode and said slotted tubing are simultaneously positioned within said slotted casing within each said at least one horizontal bore.

8. The process of claim 1 further comprising:

injecting petroleum coke breeze into said casing.

9. The process of claim 8 wherein said horizontal bore terminates beneath said storage tank in an end and said slotted casing is initially filled from said end of said bore.

10. The process of claim 1 wherein said anode is positioned so as to be substantially axially aligned within said slotted casing.

11. The process of claim 1 further comprising:

injecting water via each said slotted tubing and into contact with each said at least one anode to prevent drying of each said at least one anode.

12. The process of claim 1 further comprising:

removing said at least one anode and said tubing from said slotted casing so that said slotted casing can be used to remediate the ground beneath said storage tank or so that said at least one anode can be repaired or replaced.

13. A process for detecting leaks from and cathodically protecting an aboveground storage tank comprising:

positioning a slotted tubing within a slotted casing beneath an aboveground storage tank;

monitoring fluid transmitted via said slotted tubing to determine leakage of fluid from said storage tank;

positioning an impressed current anode within said slotted casing; and transmitting electrical current to said anode to cathodically protect said storage tank.

14. Cathodic protection, leak detection, and/or remediation apparatus for sue in conjunction with an aboveground liquid storage tank, comprising:

slotted, corrosion resistant tubing positioned in a slotted casing which is beneath the bottom of the storage tank;

at least one anode positioned within said slotted casing and juxtaposed with said tubing;

means for providing electrical current to said at least one anode to cathodically protect said storage tank; and detection means for analyzing a sample from said tubing to determine leakage of fluid from said storage tank.

15. The apparatus of claim 14 wherein said slotted tubing is positioned above said at least one anode.

16. The apparatus of claim 14 wherein said casing has a generally horizontal orientation.

17. The apparatus of claim 14 wherein said at least one anode is axially aligned within said casing.

18. The apparatus of claim 14 further comprising:

a reference cell positioned within a generally horizontal bore beneath the bottom of said storage tank for determining the amount of current transmitted from said at least one anode to the bottom of said storage tank.

19. The apparatus of claim 18 wherein said bore is deeper than said casing.

20. The apparatus of claim 14 further comprising:

a second slotted, corrosion resistant tubing positioned in a generally horizontal orientation beneath the bottom of the storage tank.

* * * * *